United States Patent [19]

Hellhake

[11] Patent Number: 4,946,119

[45] Date of Patent: Aug. 7, 1990

[54] SECURITY SUPPORT FOR FEEDING BOTTLE

[76] Inventor: Thomas M. Hellhake, 2323 Adams, Quincy, Ill. 62301

[21] Appl. No.: 437,523

[22] Filed: Oct. 30, 1989

[51] Int. Cl.[5] ..... A47B 15/00

[52] U.S. Cl. ..... 248/102

[58] Field of Search ..... 248/102–104, 248/318; 182/3

[56] References Cited

U.S. PATENT DOCUMENTS

| | | | |
|---|---|---|---|
| 784,914 | 3/1905 | Boyle | 248/102 X |
| 1,385,085 | 7/1921 | Maloney | 248/104 |
| 3,977,638 | 8/1976 | Woodward | 248/102 |
| 4,416,438 | 11/1983 | King | 248/102 |
| 4,687,078 | 8/1987 | Green | 182/3 |

FOREIGN PATENT DOCUMENTS

| | | | |
|---|---|---|---|
| 2936570 | 2/1981 | Fed. Rep. of Germany | 182/3 |
| 643655 | 8/1962 | Italy | 182/3 |
| 902429 | 8/1962 | United Kingdom | 182/3 |

*Primary Examiner*—Alvin C. Chin-Shue

*Attorney, Agent, or Firm*—Joseph W. Holloway

[57] ABSTRACT

A security support for an infant feeding bottle comprising an elongated elastic strap or sling having a first loop formed by stitching one end of the strap back onto itself and a second loop formed by placing the first loop through a ring attached to the other end of the strap. The first loop elastically embraces the neck of the feeding bottle and the second loop may be drawn around any suitable object to suspend the bottle in the event it is dropped or thrown by an infant.

3 Claims, 2 Drawing Sheets

SECURITY SUPPORT FOR FEEDING BOTTLE

BACKGROUND OF THE INVENTION

This invention relates generally to a security support in the form of an elastic strap or sling which is specifically intended for attachment to an infant feeding bottle. Such bottles usually display an open end of reduced diameter to which a nursing nipple is attachable; and, these bottles are typically made of glass or rigid plastic. Very young infants are inept in grasping and supporting an object having the size and weight of a typical nursing bottle; however, once such manipulative abilities are developed, the child is usually allowed to feed himself without help or constant attention. This mode of self-feeding may continue substantially beyond the time that the child is weaned, especially with regard to his drinking water and juices from a bottle. Accordingly, a bottle-feeding child will develop sufficient physical coordination and strength to grasp or drop his bottle as he wishes and to throw the bottle out of his crib, playpen, feeding chair, stroller or the like.

Retrieving a dropped or thrown bottle, cleaning the bottle and nipple, and restoring the bottle to the child can become a substantial chore for the child's caregiver. Should the thrown bottle break or its contents spill, the risks of bodily injury and damage to property are obvious. Moreover, a serious health hazard is encountered whenever the bottle contacts septic surfaces outside the home such as sidewalks, interior walkways in shopping malls, and floors in stores and in day care facilities and the like. In such areas, the danger of the child's exposure to disease is exacerbated by a total absence of means to sterilize a contaminated bottle, especially the nipple, or by an unavoidable inability to observe and to attend to every such episode as in a typical day care setting where many infants are fed several times a day.

One well known type of bottle supporting device commonly employed in feeding relately young infants comprises a strap or sling which is placed around the neck of the caregiver. Usually the sling carries some means for attaching the bottle to the sling; and, the sling or the attachment means may be adjustable for positioning the bottle proximate the infant's head.

U.S Pat. No. 3,065,944 issued to Liebendorfer employs a padded insulating sleeve surrounding the full length of a bottle to secure a ribbon and a pair of straps to the bottle. The ribbon is to be tied about the neck of the caregiver and the straps can be fastened together to form loops to secure the bottle to the infant or to some other object.

U.S. Pat. No. 3,144,230 issued to Brooks discloses a double D-ring connector element which is attached to a bottle by a pair of heavy rubber bands; and, the ends of a strap circling the caregiver's neck are attached to the D-ring.

U.S. Pat. No. 3,197,099 issued to Doba shows a deformable plastic strip having one end looped about the caregiver's neck and the other end formed in a coil for gripping a bottle.

U.S. Pat. No. 3,332,563 issued to Reshan illustrates a metallic clamp secured to the neck of a nursing bottle. Special linkage means, including a swivel and a snap connector, are employed to attach the clamp to an adjustable strap about the caregiver's neck so that the bottle will normally hang in a generally upright position thereby minimizing leakage through a perforated nipple.

U.S. Pat. No. 2,362,020 issued to Morrow does not employ a strap about the caregiver's neck as do the above described prior art bottle supports. Instead, a cloth sleeve fixed around the bottle by snap fasteners has pairs of support straps attached at its opposite ends; and, the straps are tied to structural elements of the basket or crib in which the infant lies. The position and angle of the bottle may be adjusted by lengthening or shortening the support straps.

While each of the abovementioned prior art bottle supports are practical when employed to assist in feeding very young infants, all of these supports appear to be unsuitable, perhaps hazardous, if an older, self-feeding child were left unattended in the presence of such supports. For example, all of these supports utilize straps, ribbons or other flexible members of considerable length so that an older, more active child could become entangled in the same and be choked or strangled. Moreover, most of these prior art supports include buttons, snaps, threaded fasteners, swivels or other metallic items which a curious child might detach and swallow or which could cut or scrape the child. Furthermore, each of these supports requires some sort of relatively complex and costly means for attaching the disclosed strap to a bottle.

An even more objectionable type of bottle support is typified by the disclosures of U.S. Pat. Nos. 784,914; 853,362; and 3,543,976 issued respectively to Boyle, Hodson and Ronald because each of these proposes that a strap or cord attached to a bottle be intentionally placed around the child's neck.

Boyle shows a leather or rubber bag in which a bottle is secured by a strap having one end sewn to the bag and the other end looped about the neck of the bottle. A neck cord having ends secured to opposite sides of the bag is placed about the baby's neck.

Hodson discloses a spring clip made of a wire loop which is bent around the neck of a bottle and takes the shape of a horseshoe. A cord passes through the adjacent ends of the wire loop and is secured thereto by a slip knot. The cord is then place around the neck or waist of the child.

Ronald states that an object of his invention is to provide a flexible strap with one end adjustable to grip the neck of a nursing bottle and the other end adjustable to pass around the infant's neck and be pivotably connected to the bottle by a spring snap.

Obviously, the neck-embracing supports of Boyle, Hodson and Ronald are abhorrent from the standpoint of infant security. While Hodson's wire clip provides a very simple means for attaching his support to a bottle, the ease with which a curious child could detach and swallow such a clip produces yet another serious hazard. Both Boyle and Ronald suggest complicated and expensive bottle attachment means as did the firstdescribed group of prior art supports.

Another approach to suppporting the feeding bottle of an older, active child is disclosed in U.S Pat. Nos. 4,564,957 and 4,096,977 issued to Scharf and to Barville, respectively. According to Scharf, a specialized vest is worn when the child is given a bottle for self feeding. A tight fitting sleeve surrounds the bottle and a pair of straps connect the sleeve to the shoulder areas of the vest whereby the bottle is susspended in front of the chest area. Additionally, the bottle surrounding sleeve may be detachably secured to the front of the vest by various forms of VELCRO[R] fasteners. Although Scharf's security garment provides dual means for securing the bottle sleeve to the garment and it is unlikely that the child could detach the bottle and drop or throw it, Scharf's attempt to solve the long-standing problem addressed by the present invention still retains the basic defects of the other prior art devices discussed above. Namely, Scharf's straps and a connected portion of the vest which extends back of the child's neck could become wrapped about his neck or caught on some protuding structure with tragic results. Furthermore, the cost and complexity of a special garment having utility only for this single purpose appear to be unwarranted.

The Barville device is functionally similar to the Scharf garment in that it employs a crossover type of harness worn about the waist and shoulders with means for securing a bottle to the front of the harness. Since the Barville device employs straps and bands about the upper torso of the child, it too is believed to be unacceptably and unnecessarily dangerous. Moreover, Barville specifies a compressible rubber ring insertable through an eyehole in a strap at the harness front for attachment to the neck of a bottle to support the latter. This arrangement raises the possibility that a child possessing sufficient manipulative skills could separate the ring from the harness and swallow the same.

SUMMARY OF THE INVENTION

It is the principal object of this invention to provide a feeding bottle support in the form of a strap or sling which eliminates the problems of the prior art devices discussed above and which provides simple yet effective means to prevent a self-feeding child from dropping or throwing a bottle onto dirty and possibly infectuous surfaces.

Another important feature of this invention is to provide a sling which elastically embraces the neck of a feeding bottle in a very secure manner yet is readily removable by an adult. To this end, the sling is fabricated of a relatively short strip of elastic cloth or elastic strapping material of any commonly available type; and, the sling includes at one end a bottle gripping loop created by stitching the strip back upon itself in such a fashion that the loop so formed will tightly embrace the necks of bottles of varying size and shape and will neatly conform to irregular bottle surfaces.

Yet another object is to provide simple yet effective means at the other end of the sling for detachably securing the same not necessesarily to a harness or garment worn by a child, but, alteratively, to some convenient structural component of the child's stroller, high chair, crib or the like. To this end, a simple ring is securely stitched to the sling at the end opposite the bottle gripping loop. To attach the sling to a tubular element of a stroller, for example, the sling is passed around the element and the pliable bottle-gripping loop is passed completely through the plastic ring and pulled therebeyond so that the ring is drawn up against the element. After so attaching the sling, the bottle is fitted into its loop at the free end of the sling.

Still another object is to provide the aforedescribed features in an elastically deformable sling having no snaps, buckles, clips or other hardware items which are relatively expensive and are dangerously attractive to a child. Likewise, the number of components of this sling has been reduced to a minimum hence its parts cost and fabrication cost are extremely low. Such simplicity makes possible a low purchase price which will encourage buyers to employ individual slings at several points of repetitive usage and to dispose of slings in the event they become soiled or worn.

These and other advantages and objects of this invention and the manner of attaining them will become apparent and the invention will be best appreciated and fully understood by having reference to the following detailed description of an embodiment of the invention taken in conjunction with the accompanying drawings.

DETAILED DESCRIPTION OF THE INVENTION

Figure 2:
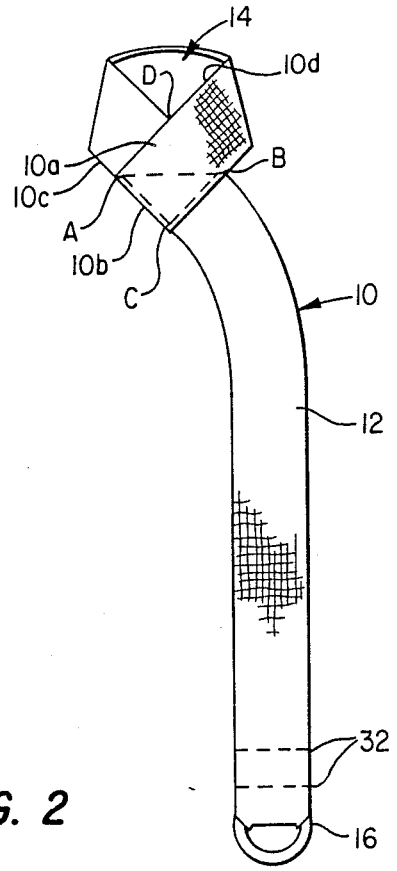
FIG. 2 is a plan view of the support.

As best illustrated in FIG. 2, the sling or support according to this invention comprises a flat band or strap, indicated in its entirity by numeral 10, having an elongated body 12, a closed loop 14 formed at one end, and a ring-like member 16 fixed to the other end thereof. Over its entire length, the strap consists of woven elastic fabric having warp made of elastic thread and weft made of some relatively inelastic thread such as nylon, for example. Thus, the strap is highly stretchable along its length, but is not similarly deformable from side to side. While the strap could be fabricated entirely of rubber-like material, it is preferred that the strap also include threads of a very tough material to render it more durable and less likely to fragment should it be chewed by a child. The preferred width of the band is greater than the diameter of ring 16 for a purpose to be disclosed hereinafter; and, its preferred length is about 10 inches from the terminus of loop 14 to the point of connection of ring 16.

Figure 4:
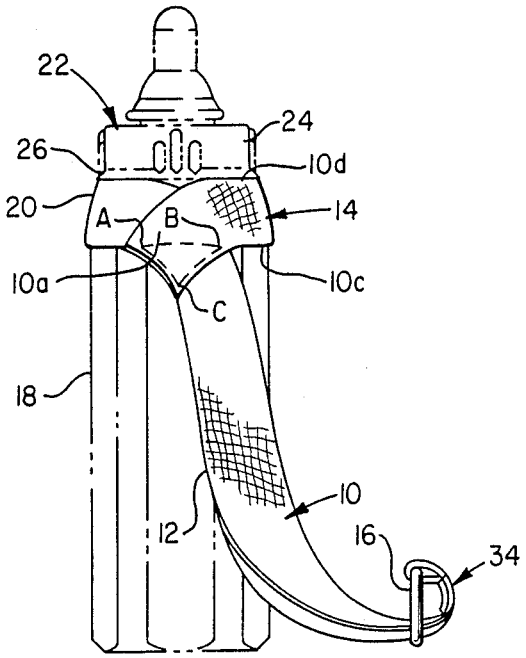
FIG. 4 is a side view of a bottle to which a support is attached.

The closed loop 14 is sized to embrace elastically the shoulder or neck portion 20 of an infant nursing bottle 18 as shown in FIG. 4. The shapes and dimensions of different types of bottles will vary somewhat; however, most bottles include a necked portion 20 having coarse external threads, not shown, terminating at the perimeter of the filling opening at the top of the bottle. When a typical nipple cap 22 is threadably attached to the bottle, the lower perimetric edge of the cap wall 24 will usually extend radially beyond and above a subjacent portion of the neck 20 forming an overhanging lip 26. As will be more fully explained hereinbelow, the bottle loop is sized and structurally adapted to embrace tightly the neck 20 and to wedge snuggly under the lip 26 whereby the strap is securely attached to the bottle and will resist the effort of a sizeable child to separate the strap from the bottle.

An important aspect of this invention is the manner in which the bottle loop 14 is fabricated. As best shown in FIG. 2, an end portion **10*a* of the strap 10 lies back upon the strap to form the loop 14. This overlying portion 10*a* extends perpendicularly across the strap body 12 and its extreme end 10*b* registers with the lower marginal edge 10*c* of the loop 14. This loop has the general configuration of an oblique conical surface which is truncated by a plane resting on the loop's upper margin 10*d*. Such a conical configuration will generally coincide with the tapering neck surfaces exhibited by most feeding bottles. Portion 10a is secured to the subjacent strap body 12 by trangular stitching which connects three points, A, B and C, defined by the intersection of the overlying marginal strap edges. It will be noted, however, that contrary to normal expectations, there is no stitching connecting either points A or B to a point D where the upper margin 10d of the loop 14 intersects itself. This inventive omission is intended to afford the somewhat shorter upper margin 10d of the truncated loop 14 an opportunity to deform substantially to the same extent as the lower margin 10c. Stated otherwise, if stitching were present at point D, the incremental elastic elongation of the strap's marginal segments AD and BD would be denied the loop's upper edge 10d. Furthermore, the presence of stitching at point D would mean that the maximum bottle diameter receivable in a fully deformed loop 14 would be dictated by the shorter upper marginal edge 10d rather than the longer lower marginal edge 10c. This would be contrary to the present invention wherein the maximum elastic gripping force is applied at and adjacent the lower margin 10c of the loop 14 while the remainder of the loop conforms snuggly to the shape and size of the smaller neck of the bottle 18 and underlies the cap lip 26**.

Turning now to the other end of the inventive support 10, the ring 16 is attached thereto by inserting an end portion 30 of strap body 12 through the ring 16 and, thereafter, sewing together overlapping portions of the strap 10 by means of a double row of stitching 32 adjacent the ring 16 whereby the risk that a child could remove the ring and swallow the same is eliminated or at least reduced to a minimum. The ring is made of smooth, nontoxic plastic material; and, if desired the member 16 may have a shape other than circular.

Figure 3:
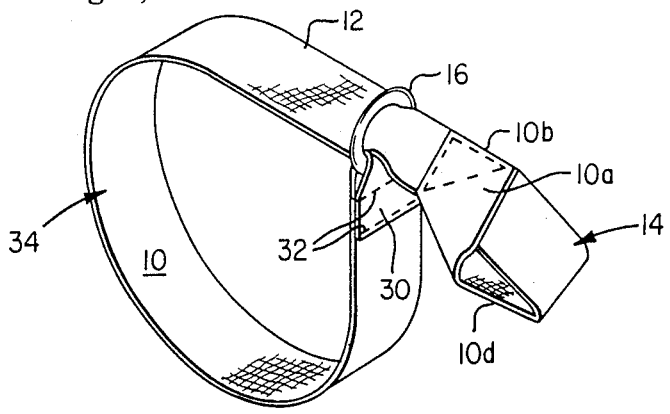
FIG. 3 is a perspective view of the support.

The function of the aforedescribed ring 16 is to coact with the strap body 12 to define an adjustable attachment loop 34 for securing the strap 10 and the bottle embraced thereby to an object penetrating the loop 34. From FIG. 3 it will be understood that the loop 34 is formed without complex manipulative steps by simply drawing the entire loop 14 through the ring 16. Depending on the accessibility of the object to which the attachment loop 34 is to be secured, the sling 10 may be formed as shown in FIG. 3 and then placed about an object that is free to project through loop 34. However, if the object has no free end to pass through loop 34, the object must be surrounded by the strap body 12 prior to inserting the bottle loop 14 through ring 16. In either event, the attachment process is completed by pulling the bottle loop through the ring until the loop 34 elastically embraces the object with a snug fit. This snug but not extremely tight fit will be substantially maintained by the frictional drag of the strap body 10 against the surrounding ring 16; however, the loop 34 can be enlarged or taken apart quite easily for removal of the sling from the object to which it is attached.

Figure 1:
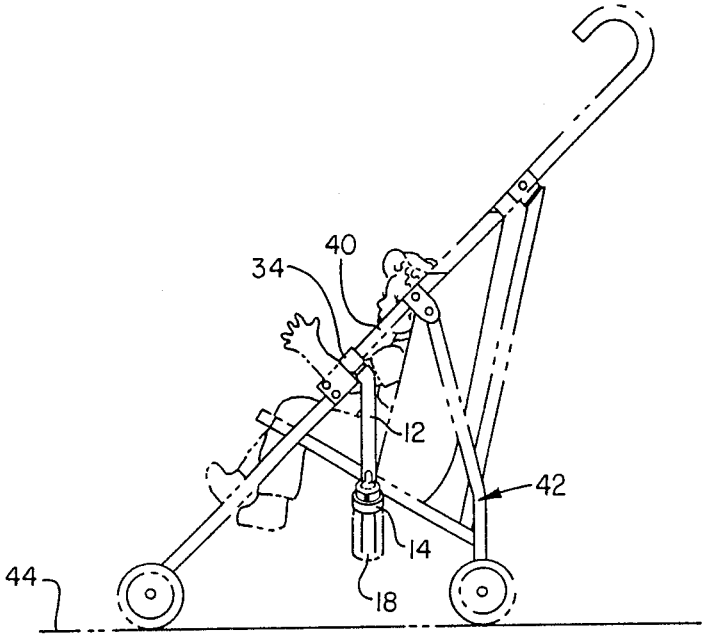
FIG. 1 is a side view of a child's stroller to which a bottle is attached by means of a security support constructed in accordance with this invention.

It will be obvious that so long as a bottle 18 is engaged by the bottle loop 14, the sling 10 cannot be detached from an object lacking a free end. This situation is shown in FIG. 1 where the attachment loop 34 surrounds a tubular frame element 40 of a child's stroller 42. Even should the child depicted in FIG. 1 succeed in sliding the ring 16 along the strap body 12 until the ring encounters the bottle loop 14, the sling cannot become detached. Moreover, the opening defined between the inside of the looped strap and the frame element 40 cannot be made great enough to receive the child's head since the length of the strap body 12 is purposely made short to forestall contact between the suspended bottle and the underlying surface 44. If the child possesses sufficient dexterity, he can retrieve the bottle without the assistance of a caregiver.

Since the sling 10 comprises only two parts which are commonly available, a commercial embodiment of this invention can be provided at very low manufacturing and material costs. This is contrary to the showing of the aforedescribed prior art bottle holding devices all of which are structurally more complicated, therefore more expensive to make; and, again because of such complication, these known devices could create hazards for the child using them.

The foregoing description of a preferred embodiment of the invention is illustrative and explanatory only and various changes in size, shape and materials as well as in specific details of the illustrated construction may be made without departing from the scope and spirit of the invention.

What I claim as my invention is:

1. A security support for an infant feeding bottle, comprising:

(a) an elastically deformable strap having an elongated body terminating in opposed end segments;

(b) a bottle-gripping loop formed by one end segment of said body which is attached back upon said body by stitching;

(c) a ring member stitched to the other end segment;

(d) said bottle-gripping loop as formed by said one end segment being extendable through said ring member;

(e) an adjustable loop for attaching said strap to a selected object; and, (f) said adjustable loop defined by the extension of said bottle-gripping loop and an adjacent portion of said body through and beyond said ring member;

(g) said one end segment overlies said body whereby the marginal edges of said one end segment intersect the marginal edges of said body at four points; and, (h) less than all of said points are stitched together, (i) three of said intersecting points are stitched together.

2. The security support according to claim 1, wherein:

said bottle-gripping loop is formed by said one end segment in the general configuration of a truncated conical surface.

3. The security support according to claim 2, wherein:

said bottle-gripping loop has spaced marginal edges which define diameters of said truncated conical surface; and, the maximum degree of strap deformation at both diameters is substantially the same.

* * * * *